United States Patent [19]

Farrar

[11] Patent Number: 4,979,447

[45] Date of Patent: Dec. 25, 1990

[54] COMBUSTION OF CARBON CONTAINING MATERIALS IN A FURNACE

[75] Inventor: David H. Farrar, Scarborough, Canada

[73] Assignee: Velino Ventures Inc., Toronto, Canada

[21] Appl. No.: 362,848

[22] Filed: Jun. 7, 1989

Related U.S. Application Data

[63] Continuation-in-part of Ser. No. 204,713, Jun. 9, 1988, abandoned.

[51] Int. Cl.[5] ..... F23J 11/00; F23J 15/00

[52] U.S. Cl. ..... 110/345; 44/640; 110/342

[58] Field of Search ..... 44/641, 640; 110/345, 110/348, 342

[56] References Cited

U.S. PATENT DOCUMENTS 3,122,577 2/1964 Lindstrom .
3,217,022 11/1965 Cordes .
3,535,356 10/1970 Hartle .
3,564,034 2/1971 Combs et al. .
3,577,449 5/1971 Ashmore .
3,739,004 6/1973 Ponder .
3,816,380 6/1974 Reed, Jr. .
3,878,233 4/1975 Nielsen .
3,927,992 12/1975 Kerley ..... 110/348
3,989,731 11/1976 Talbot .
4,108,696 8/1978 Ashmore et al. .
4,256,703 3/1981 Dixit et al. ..... 44/641 X

*Primary Examiner*—Edward G. Favors
*Attorney, Agent, or Firm*—Basile and Hanlon

[57] ABSTRACT

A process for improving combustion efficiency in a coal-fired furnace comprising injecting an additive composition comprising a ferrocene compound or its derivatives and an organic carrier liquid in which the ferrocene or its derivatives is soluble, has a high flash point and is an injectable liquid at operating temperatures wherein the quantity of air introduced to the furnace is reduced to low $NO_x$ emissions with minimal increase in soot emissions.

9 Claims, 4 Drawing Sheets

KEYBRD.
ROM
RAM
CONTROLLER

COMBUSTION OF CARBON CONTAINING MATERIALS IN A FURNACE

This application is a continuation-in-part of United States patent application Ser. No. 204,713 filed June 9, 1988 abandoned.

FIELD OF THE INVENTION

This invention relates to additive compositions for improving combustion efficiency in coal-fire furnaces and other related types of equipment.

BACKGROUND OF THE INVENTION

Considerable study and investigation has been undertaken with respect to coal-fired furnaces for use in generation of heat. Such furnaces are presenting major environmental concerns in most industrialized areas. In the combustion of coal, many combustion products which emerge from the stack of the system can cause, or have the potential to cause environmental damage. One of the problems of particular concern is soot emissions from the stacks of coal-fired furnaces. This is due primarily to incomplete combustion of the coal in the furnace. Steps have been taken to remove the soot from the emissions; however, there becomes an economic balance with respect to how much of the soot can be removed versus the costs in doing same. To reduce the pressures on soot removal systems, it would be advantageous to improve combustion in the coal-fire furnaces. Many steps have been taken in this regard with respect to controlling the particle size of the pulverized coal which is fed to the fireball of the furnace. Furthermore, the supply of air is adjusted to provide as complete as possible combustion within the furnace. It has even been contemplated to add various catalysts and the like to the pulverized coal to enhance combustion in the fireball.

Soot control has also been studied with respect to the combustion of fuel oils in oil-fired furnaces. For example, U.S. Pat. Nos. 2,818,416; 2,898,359; 3,122,577; 3,217,022; 3,341,311; 3,535,356 and 3,989,731, disclose that an iron-containing compound ferrocene has been used to improve combustion of the fuel oils and gasolines. It is also known to use ferrocene as an additive to improve combustion of solid propellants, such as rocket fuels. Use of ferrocene in this regard is disclosed in U.S. Pat. Nos. 2,694,721; 3,564,034; 3,577,449; 3,739,004; 3,813,307; 3,816,380; 3,878,233 and 4,108,696.

SUMMARY OF THE INVENTION

Surprisingly and in accordance with an aspect of this invention, the inventors have found that the introduction of ferrocene or one or more of its derivatives in a suitable carrier into the fireball of the coal-fired furnace significantly improves the combustion of the coal in the fireball, significantly reduces soot emissions and maintains an acceptable level of $NO_x$ emissions.

According to another aspect of the invention, a process for improving combustion efficiency in a coal-fired furnace while maintaining acceptable levels of $NO_x$ emissions from such combustion is provided. The coal-fired furnace has at least one site for introducing a pulverized coal into the furnace to develop and maintain a fireball in the furnace and at least one site for introducing air to support burning of the pulverized coal in the fireball.

The process comprises introducing at at least one site a useful amount of an additive composition for measurably improving combustion efficiency while maintaining acceptable levels of $NO_x$ emissions by controlling excess air requirements to support the burning of the pulverized coal. The composition comprises:

(1) a compound selected from the group consisting of ferrocene and its derivatives represented by the formula:

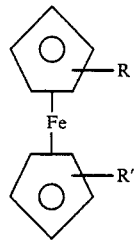

wherein each of R and R', independent of the other, is hydrogen, alkyl, cycloalkyl, aryl or heterocyclic, and (2) an organic carrier liquid in which said dicyclopentadienyl iron compound is soluble.

Excess air, as supplied to the furnace, is controlled to support burning of the pulverized coal level which emits an acceptable concentration of particulates containing carbon at a desired combustion efficiency where use of the additive permits 1. reducing excess air supply to the furnace compared to a normal excess air requirement for combustion in the absence of the additive to achieve in the presence of the additive the desired combustion efficiency and an acceptable concentration of particulates of carbon at the reduced supply of excess air; and
2. simultaneously maintaining a level of $NO_x$ emissions which is below normal levels of $NO_x$ emissions in the absence of the additive for combustion of the coal at a level which achieves the desired combustion efficiency and the acceptable concentration of particles of carbon.

The amount of the composition used is determined by several factors, such as, the coal quality, rate of coal delivery, and efficiencies of the burner operation. The concentration of the composition injected into the fireball is determined on the basis of the parts per million (ppm) of iron of the composition in the presence of the amount of coal delivered to the fireball at any instant. The useful lower limit for the amount of composition used is the necessary ppm of iron essential to effect a measurable increase in combustion efficiency. The useful upper limit is that which does not effect any further measurable increase in combustion efficiency. It is appreciated that a measurable increase in efficiency is usually in the range of 1% increase up to approximately a 99% increase. For most applications, the amount of iron of the composition used is in the range of 0.5 ppm up to 100 ppm. Injection of the composition into the fireball reduces soot emissions appreciably by improving at least latter stages of combustion efficiency in the upper regions of the fireball and simultaneously maintaining an acceptable level of $NO_x$ emissions.

BRIEF DESCRIPTION OF THE PREFERRED EMBODIMENTS

Preferred embodiments of the invention are shown in the drawings, wherein.

DETAILED DESCRIPTION OF THE PREFERRED EMBODIMENTS

Figure 1:
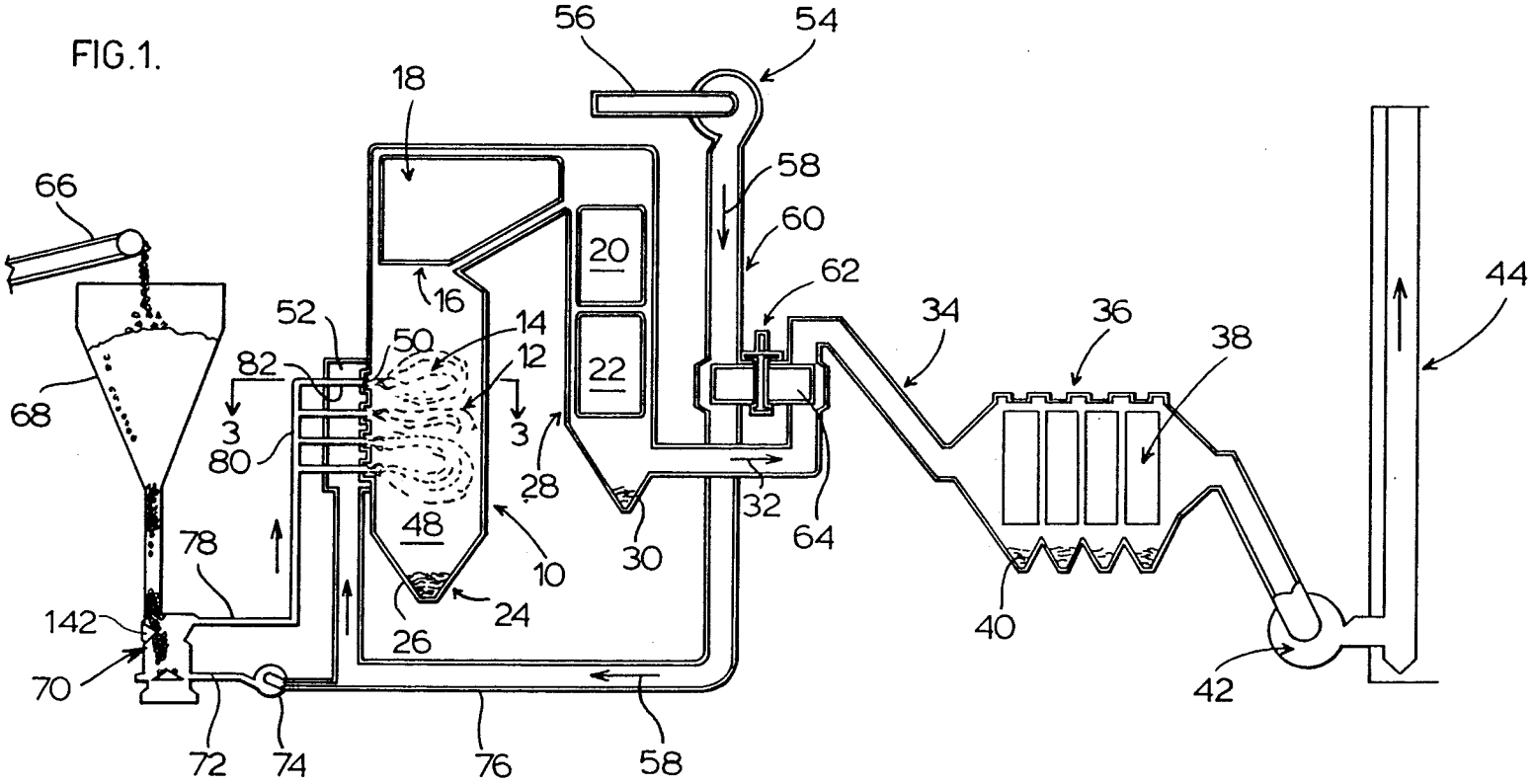
FIG. 1 is a schematic of a coal-fire furnace with emission removal systems.

A representative sketch of a coal-fired furnace is shown in FIG. 1. The furnace 10 has a fire box 12 which may be in the range of 100 feet across and 100 to 150 feet high. A fireball 14 is established within the fire box 12 of the furnace to generate heat which flows upwardly in the direction of arrow 16. The heat is removed from the hot combustion gases in the heat exchangers 18, 20, and 22. The temperature of the exhaust gases in the region of heat exchanger 18 are in the range of 1300° C. to 1400° C. In the region of heat exchanger 20, the temperature has dropped to approximately 700° C. to 800° C. In heat exchanger 22, the temperature of the gases emerging from the heat exchanger is in the range of 300° C. to 400° C. The bottom of the furnace 24 includes an ash hopper 26. Similarly, at the base of the heat exchanger system 28 is an ash hopper 30 to remove particulates which naturally settle out as the exhaust gases travel through the system. The exhaust gases continue to travel in the direction of arrow 32 through duct 34 which transfers the gases into an electrostatic precipitator 36 having electrostatic cells 38. The removed ash is collected in ash hoppers 40 which may be discharged on occasion and drawn away in a truck or the like. A fan 42 is provided to exhaust the cooled emissions which are in the range of 120° C. up the stack 44 in the direction of arrow 46.

The fireball 11 is developed in the fire box 12 of the furnace by igniting pulverized coal which is introduced to the region. Although not shown, suitable natural gas burners are provided in region 48 to ignite pulverized coal as it is introduced through the nozzles 50. Combustion air is introduced from the plenum 52 around the nozzles 50 to support combustion in the fireball 14. By way of the natural gas burners in the region 48, the pulverized coal is ignited to develop a fireball which is then self-maintaining as long as coal and air are fed to the system. The plenum 52 is supplied with pressurized air by the fan 54 which has an intake at 56. The pressurized air travels in the direction of arrows 58 through the conduit 60. The combustion air may be heated by way of a rotary air heater 62 which extracts some of the hot air from conduit 34 of the exhaust stream 32 to heat the incoming air as it passes over the rotary heater blades 64. Sufficient pressure of combustion air is maintained in plenum 52 to feed the necessary amount of air to the system. Although not shown, it is appreciated that a control may be provided at the nozzles 50 to control the amount of air entering the system to provide for a slight excess of theoretical needed for complete combustion of the carbon containing materials and other materials present in the coal such as nitrogen and sulfur containing compounds.

The coal to be supplied to the furnace is delivered on conveyor 66 into the coal bunker 68. The coal is then fed to a coal pulverizer 70 which has an air feed in line 72 from compressor 74 which removes some of the pressurized air in the duct 76. The pulverized coal, by way of the pressurized air, is fed through conduit 78 to a manifold 80. A plurality of injection conduits 82 are provided which are in communication with the respective nozzles 50. The pulverized coal is ejected from the nozzles 50 into the fireball 14 to maintain the fireball. As already noted, the necessary combustion air is provided in the plenum 52 and enters into the fire box 12 in a manner to be discussed in more detail with respect to FIG. 2.

Figures 2, 3, 4:
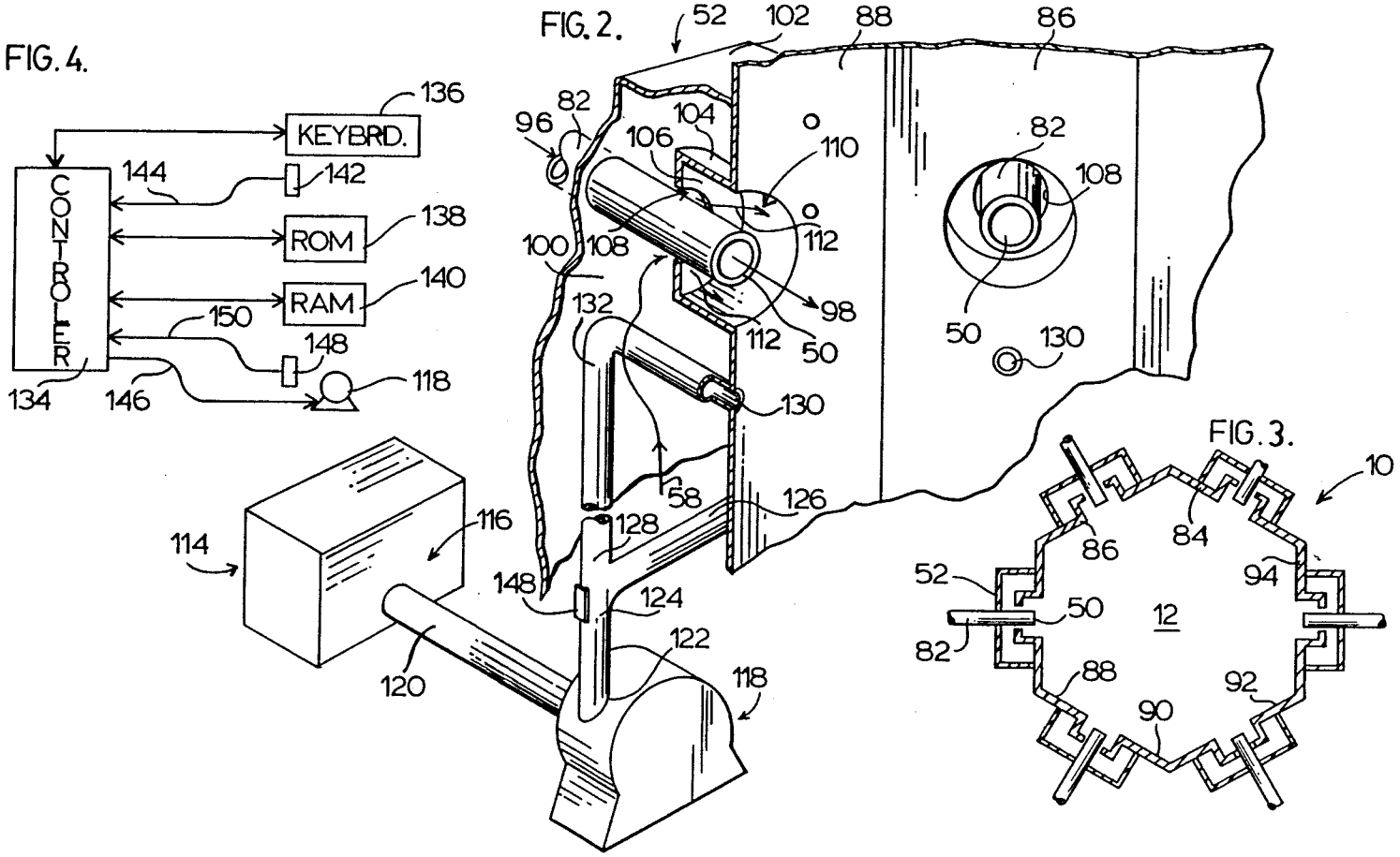
FIG. 2 is a section through a portion of the furnace wall showing pulverized coal, air and additive composition injection sites.
FIG. 3 is a section along the lines 3—3 of FIG. 1.
FIG. 4 is a schematic of an electronic controller system for metering the injection of the additive composition.

As shown in the section of FIG. 3, the furnace 10 has a fire box 12 defined by six opposing side walls 84, 86, 88, 90, 92 and 94. According to this particular embodiment, each side wall has a plurality of sites for introducing the pulverized coal and the necessary air to support combustion. For example, side wall 88 has the pulverized coal injection conduits 82 with nozzles 50 as well as the plenum 52 which supplies the oxidizing air for introduction to the fire box in the region of the fireball. The similar arrangement is provided on all of the other side walls of the furnace, which is common practice in most coal-fired furnace operations. Although it is understood that some furnaces burn considerably less coal, thereby requiring fewer introduction sites, for example, there may be only one or two sites of introduction on those side walls which carry the system.

With reference to FIG. 2, further details of the injection system for the coal and air are shown. For example, with side wall 88 the nozzle 50 is positioned in the region of the plane of the side wall. The nozzle 50 is fed through conduit 82 where the pulverized coal and air enter in the direction of arrow 96 and emerges from the nozzle in the direction of arrow 98 into the fireball 14. With reference to side wall 86, the same structure is provided with a nozzle 50 and conduit 82 for delivering the pulverized coal to the nozzle. It is appreciated that a variety of nozzle arrangements are available for introducing the pulverized coal into the fireball. Hence the showing in FIG. 2 is merely illustrative of the variety of nozzles commonly used in coal-fired furnaces.

Also graphically illustrated is the introduction of the necessary air to maintain combustion in the fireball. The plenum generally designated 52 has a rear wall 100, a top wall 102 and side walls which are not shown. The plenum carries the pressurized air which travels upwardly in the direction of arrow 58 The nozzle conduit 82 is surrounded by a casing 104 having an end wall 106 with an opening 108. The opening 108 is larger than the conduit 82, so as to provide an annular space 108 about the conduit. This allows the pressurized air to travel through the annular opening into the space which again is of annular shape 110 and emerge into the fireball in the direction of arrows 112.

The additive composition for improving the combustion of the feed coal is stored in a storage tank 114. The tank has an outlet at 116 which feeds the pump 118 via the conduit 120. The outlet of the pump 122 is connected to piping 124. The piping 124 has several branches leading therefrom, such as branches 126 and 128. Each branch 128 supplies a plurality of injector nozzles 130. The branch 128 functions as a manifold to which a plurality of conduits 132 are in communication to supply the series of nozzles 130 which are located, according to this embodiment, beneath each pulverized coal entry site With reference to FIG. 1, each wall of the furnace may have a plurality of pulverized coal injection nozzles 50 such as the four which are vertically arranged. According to the embodiment shown in FIG. 2, an injector nozzles 130 may be located beneath each of the pulverized coal entry ports. However, it is understood that depending upon the loading of the furnace with pulverized coal, fewer injection ports for the additive composition may be required and the injection points could be located elsewhere in the furnace wall, as long as the location ensures that the composition is carried into the fireball. In that situation, a single nozzle 130 may be located beneath just one of the entry sites for the pulverized coal. It is also understood that not every wall need include an injection nozzle site for the additive composition; again depending upon the volumes to be introduced for the anticipated capacities of quantity of coal burned in the furnace In any event, the single pump 118 can supply all nozzles arranged around the perimeter of the furnace for injection of the additive composition at each selected site. It is appreciated that the storage tank 114 is of sufficient capacity to provide for several hours of operation of the furnace and can be readily replenished with additional additive composition on a demand basis.

The additive composition comprises:

(1) a compound selected from the group consisting of ferrocene and its derivatives represented by the formula:

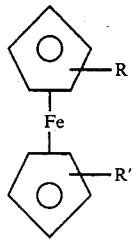

wherein each of R and R', independent of the other, is hydrogen, alkyl, cycloalkyl, aryl or heterocyclic, and (2) an organic carrier liquid in which said dicyclopentadienyl iron compound is soluble and which is an injectable liquid at operating temperatures in the environment exterior of such furnace.

In respect of Formula I, the term alkyl refers to an alkyl group branched or straight chain of 1 to 10 carbon atoms, such as methyl, ethyl, propyl, n-butyl, hexyl or heptyl. The term cycloalkyl refers to a lower cycloalkyl group of 3 to 7 carbon atoms, such as cyclopentyl or cyclohexyl. The term aryl refers to an organic radical derived from an aromatic compound by the removal of one hydrogen atom. Such compounds include phenyl and substituted phenyl such as lower alkyl substituted phenyl. These compounds include tolyl, ethylphenyl, triethylphenyl, halophenyl, such as chlorophenyl, or nitrophenyl. The term heterocyclic refers to pyrryl, pyridyl, furfuryl and the like. The aryl or heterocyclic group generally contains up to about 15 carbon atoms.

Dicyclopentadienyl iron is commonly referred as "ferrocene". Hence the compounds of the above formula I are considered to be ferrocene and its derivatives. The preferred compounds of Formula I include ferrocene(dicylopentadienyl) iron, di(methylcyclopentadienyl)iron, di(ethylcyclopentadienyl)iron, methylferrocene, ethylferrocene, n-butylferrocene, dihexylferrocene, phenylferrocene, m-tolyferrocene, didecylferrocene, dicyclohexylferrocene, and dicyclopentylferrocene.

The organic carrier liquid is of a type in which the selected dicyclopentadienyl iron compound is soluble. Furthermore, the carrier liquid has a high flash point and is of a viscosity at operating temperatures which enables injection through the injection nozzles 130. Preferably, the flash point of the carrier liquid is in excess of 74° F. and has a boiling point in excess of 95° F. The viscosity of the carrier is normally 50 centipoises or less at 20° C. and is preferably in the range of 0.3 to 3 centipoises at 20° C. Suitable organic carrier liquids, i.e. solvents, are either of the aromatic or hydrocarbon type. Aromatic solvents include xylenes, toluenes and Solvesol 100 TM (commercially available from Imperial Oil) which is a mixture of benzenes and naphthalenes having a flash point in the range of 100° F. Suitable hydrocarbons include alcohols, such as hexanol, octanol. Other hydrocarbons includes fuel oils, kerosene, petroleum spirits and the like. The solvents of this nature have a functional flash point with low viscosity. The stable and one in which the selected additive is soluble. Of course, the selected solvent is non-toxic when combusted.

It is appreciated that the additive composition may include a variety of commercial dyes to provide a distinctive color for the composition and distinguish it from other compositions used about the coal-fired furnace operation. The containers for the additive composition should be explosion safe and are suitably handled. The tank itself should also be suitably equipped to minimize the risk of explosion and fire.

With reference to FIG. 4, a schematic representation of an electronic control circuit for controlling the rate of injection of additive composition is shown. The controller 134 may be of any standard type of microprocessor system which is programmable by way of a keyboard 136 and its internal program contained in the read-only memory 138. In addition, the random access memory 140 is provided for additional programming instruction and the storage of data developed during the day's operation. The controller also has input from a standard flow sensing device 142 which is provided in the hopper to weigh the coal flowing into the grinding unit. The purpose of flow sensor 142 is to detect on a periodic basis the rate of flow of pulverized coal delivered through to the furnace. This information is fed to the controller via line 144. Based on the input information from the keyboard 136 and the program in the read-only memory 138, the controller 134 generates a signal in line 146 to control the rate of pumping of pump 118. As is understood by those skilled in the art, the signal in line 146 may be such to develop a particular rpm for the pump 118 in providing the necessary pressure to feed and inject the additive composition at the desired rate through the nozzles 130. For purposes of feedback, a flow sensor 148 is provided in pipe 124 as shown in FIG. 2 to provide feedback to the controller via line 150 to indicate the rate of flow of the additive composition emerging from the pump 118. The controller then through this feedback loop can further adjust the rpm of the pump 118 to develop the desired flow rate in the line 124. All of these adjustments in the rpm of the pump 118 are based on the program which is loaded into the memory of the controller 134.

The rate of flow of coal into the furnace may be in the range of 25 pounds per hour up to 170 tons per hour. Based on the amount of iron in the additive composition, it is desired to provide from 0.1 part per million up to 100 part per million of iron in the additive composition relative to the amount of coal being fed at any instant to the furnace. There are, of course, situations where excessive amounts of additive composition are not required and it is found that for most types of coal feeds an additive composition in the range of 0.1 ppm up to 5 ppm of iron relative to the amount of coal is normally sufficient. The program provided in the memories of the controller 134 is therefore adapted to provide the necessary control on the pump 118 to deliver the desired amount of additive composition per unit of time based on a known feed rate of coal to the system.

The system for measuring the flow rate of coal through the ducting 78 may be of any type of suitable weighing device which is capable of weighing the amount of coal which flows into the hopper which, in turn, feeds the pulverizer. Although the preferred technique of introducing the ferrocene additive is in accordance with the above described injection technique, particularly for large furnaces, it is appreciated that a variety of other techniques may be employed for introducing the ferrocene additive to the burning coal. For example, the ferrocene additive may be admixed with the pulverized coal before introduction to the furnace or introduced with the supplied air for supporting combustion.

A significant benefit from the injection of this type of additive composition is the increase in combustion efficiency resulting in a decrease in soot emissions; i.e., particles containing carbon. Based on experimental uses of this composition, in essentially industrial conditions, reductions of up to 75% are readily obtained. These dramatic effects can be achieved even in high performance furnace systems which already have very low soot emissions. By use of this composition, according to this invention which is commonly sold under the trade mark CARBONEX by the applicant, there is the obvious savings associated with increasing a Btu output of the fuel supply. The increased combustion efficiency reduces fowling and corrosion which improves heat transfer, extends equipment life, reduces maintenance costs and minimizes interruptions of plant operations. Other efficiency gains include lower excess air requirements, reduced fan power for soot blower operation, the ability to employ effectively a lower quality, lower cost fuel and better recovery of a marketable ash. The use of a Carbonex also has an indirect effect in the lowering acid forming components in the ignition. It is known that soot adsorbs sulfuric acid formed during combustion and contributes to its formation via reaction on the carbon surface. If such acid-containing soot particulates are released to the atmosphere, this commonly results in acid smut fall-out. However, in accordance with this invention by reducing the soot emissions, there is a corresponding reduction in acid emissions. A further benefit in the use of Carbonex is by reducing soot in the emissions, there is a corresponding reduction of the smaller particulates of soot in the atmosphere. It is well understood that particles smaller than 15 micron may remain suspended in the atmosphere for long periods and hence can be inhaled. However, by use of the Carbonex additive, there is a considerable reduction in the smaller particulates of soot in the emissions from the coal-fired furnace.

To test the effectiveness of the additive compositions of this invention, a pilot plant scale coal-fired combustion furnace was used with suitable hardware for testing emissions. Combustion performance was measured by analyzing for the following emissions in the exhaust gases: carbon dioxde ($CO_2$); carbon monoxide (CO); oxygen ($O_2$); nitrogen oxides ($NO_x$), sulfur dioxide ($SO_2$), particulates ($RO_x$) The following analytical techniques were employed to measure these values in the exhaust gases. Non-dispersive infrared was used to measure CO and $CO_2$ emissions. Paramagnetism was used to measure oxygen concentration. Chemiluminescence was used to measure the $NO_x$ emissions. Pulsed fluorescence was used to measure the $SO_2$ emissions and method "Five" in the "Standards of Performance for New Stationary Sources" Federal Register 36, No. 247, 24876, Dec. 23, 1971 was used to measure the particulate material as well as to analyze the following characteristics of the particulate material in the emissions; namely:

particulate loading
carbon content
ash content
particle size distribution.

The pilot plant scale furnace operated on an average of 600 to 700 KBtu per hour. The concern, of course, was the predictability of the operation of this facility emulating those which would be obtained in the utility scale furnace firing at rates of $1000 \times 10^6$ Btu per hour or more. Based on prior experience, it has been found that there is a fairly close relationship between the laboratory scale or pilot plant scale burner and a utility scale furnace in terms of effects of additives on combustion efficiency.

To determine the effectiveness of the additive compositions of this invention, a representative sample of coal was obtained for testing. The coal had the following characteristics as set out in Table I.

TABLE 1

TEST COAL CHARACTERISTICS

| Fuel Characteristics | Bituminous Coal |
|---|---|
| Heating Value (Btu/pound, dry) | 12,779 |
| Proximate Analysis (weight %, dry) | |
| Volatile matter | 41.38 |
| Fixed carbon | 48.59 |
| Ash | 10.03 |
| Ultimate Analysis (weight %, dry) | |
| Carbon | 70.42 |
| Hydrogen | 5.07 |
| Nitrogen | 1.33 |
| Sulfur | 4.01 |
| Oxygen | 9.14 |
| Ash | 10.03 |

EXAMPLE 1

In view of the organic liquid carrier having the ability to affect overall combustion process, an exemplary carrier was first tested to determine what if any impact it would have on combustion efficiency. According to this example, the carrier liquid used was xylene. The additive composition consisted of 5000 ppm by weight of iron in ferrocene distributed in a xylene carrier. This composition was diluted to provide the necessary appropriate iron concentrations in the coal-fired furnace. Xylene was therefore used with and without the ferrocene to provide the following test results summarized in Table 2.

TABLE 2

RESULTS OF COMBUSTION TESTS ON PULVERIZED BITUMINOUS COAL FLAMES INJECTED WITH CARBONEX

| Combustion Performance Characteristic | Agent Injected Into Bituminous Coal Flame | | |
|---|---|---|---|
| | Xylene (0 ppm iron) | Carbonex (1 ppm iron) | Carbonex (5 ppm iron) |
| Furnace-Gas Exit Temperature | 2190 | 2225 | 2210 |
| $O_2$ (%, volume) | 5.2 | 5.1 | 5.2 |
| $CO_2$ (% < volume) | 16.6 | 15.9 | 16.2 |
| CO (ppm, volume) | 50 | 50 | 40 |
| $NO_x$ (ppm, volume) | 420 | 430 | 730 |
| $SO_2$ (pm, volume) | 3900 | 4100 | 3980 |
| Carbon in Particulate Ash (%, weight) | 3.1 | 2.8 | 0.8 |
| Average Ash Particle Size (microns) | 18 | 40 | 20 |
| Fine Particulate Ash (% < 5 microns) | 8.0 | 3.2 | 6.4 |
| Particulate Loading (pounds/million Btu) | 3.2 | 2.9 | 5.5 |
| Combustion Efficiency (%) | 99.62 | 99.62 | 99.88 |

The first column with 0 ppm of iron, has coal plus the carrier (Xylene), provides a base line burn to which other burns involving ferrocene can be compared. Thus the overall efficiency prior to additive injection is presented in this column.

Compared to the results obtained in using xylene, it is apparent that the Carbonex composition containing ferrocene had a dramatic effect on reduction of carbon in the particulate ash. Compared to the results in using xylene, one ppm of iron in the Carbonex composition resulted in a reduction of carbon in particulate ash from 3.1% by weight down to 2.8% by weight. Increasing the concentration of Carbonex injected into the flame to a level of 5 ppm of iron in the ferrocene resulted in the reduction to 0.8% by weight of carbon in the particulate ash. This results in a combustion efficiency percentage increase from 99.62 with just xylene to 99.88% in the presence of Carbonex.

The following table provides an analysis of the resultant data on the basis of change in combustion performance.

TABLE 3

EFFECT OF CARBONEX ADDITIVE ON BITUMINOUS COAL COMBUSTION VERSUS IRON LEVEL AND APPLICATION METHOD

| Text Parameter | Change in Combustion Performance Upon Use of Additive (Carbonex) | |
|---|---|---|
| Test Fuel | Coal | Coal |
| Additive Iron Concentration (ppm) | 1 | 5 |
| CO (ppm, volume) | 0 | −10 |
| $NO_x$ (ppm, volume) | +10 | +310 |
| $SO_2$ (ppm, volume) | +200 | +80 |
| Ash Loading (%) | −9 | +72 |
| Average Ash Particle Size (%) | +122 | +11 |
| Fine Particulate Ash (%) | −60 | −20 |
| Carbon in Particulate Ash (%) | −10 | −74 |
| Combustion Efficiency | 0 | +0.26 |

TABLE 3-continued

EFFECT OF CARBONEX ADDITIVE ON BITUMINOUS COAL COMBUSTION VERSUS IRON LEVEL AND APPLICATION METHOD

| Text Parameter | Change in Combustion Performance Upon Use of Additive (Carbonex) |
|---|---|
| (%, absolute) | |

Based on the above analysis of the change in combustion performance, the following advantages were realized. A significant reduction in carbon and particulate ash was realized from −10% to −74% injecting from 1 ppm of Carbonex iron up to 5 ppm of Carbonex iron into the coal flame. This resulted in an increased combustion efficiency of 0.26% compared to the combustion efficiency with the 0 ppm of Carbonex iron. The use of 5 ppm Carbonex iron injected into the coal flame increased ash loading by 72%, average particulate size by 11% and increased $NO_x$ emissions by 310 ppm.

Figure 5:
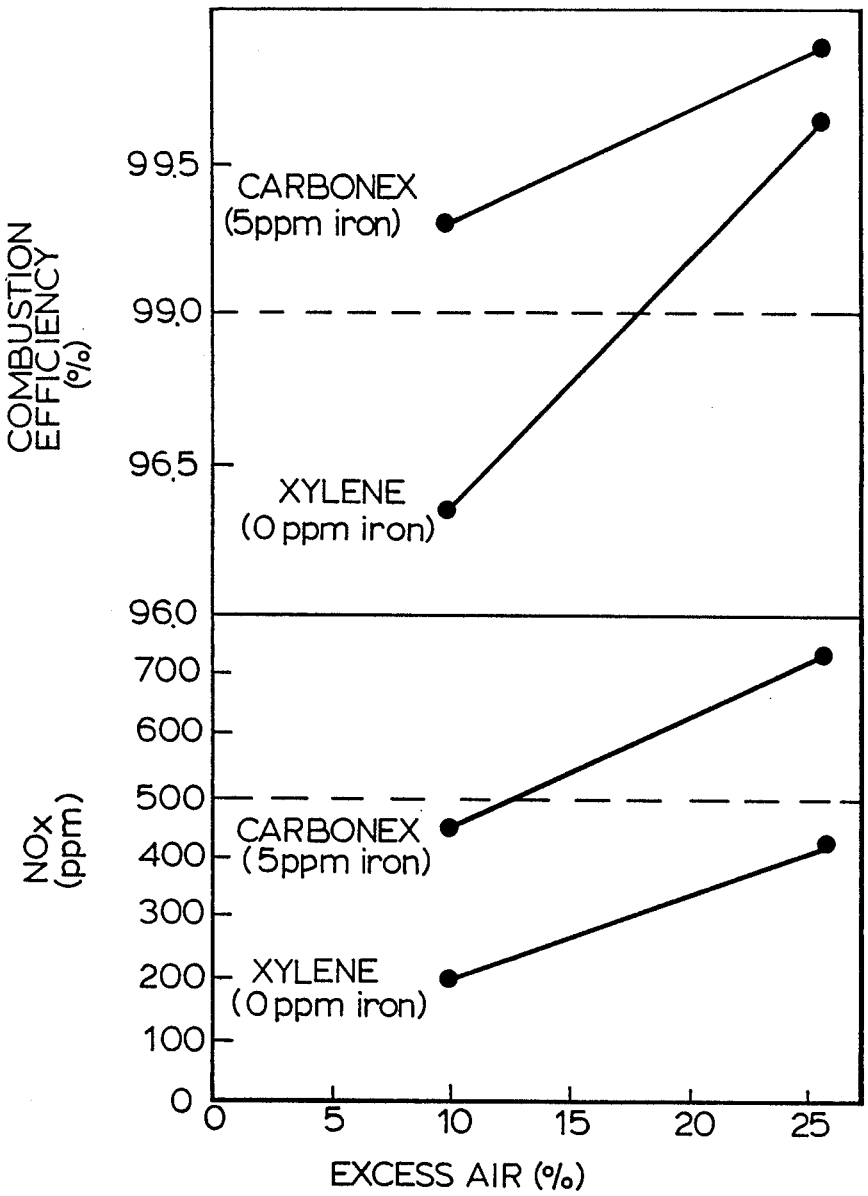
FIG. 5 is a pair of graphs illustrating the effects of Carbonex and excess air on combustion efficiency and $NO_x$ emissions.

By use of increased concentration of Carbonex, the increased $NO_x$ emissions exceed compliance levels. It was proposed that a reduction in the level of supplied air would reduce the $NO_x$ emissions back to compliance levels. Tests have shown that reducing the excess air level from 26% to 10% resulted in reduction of $NO_x$ emissions back to compliance levels as confirmed in Table 4 and FIG. 5. This is quite surprising; however, without being bound to any theory it is believed that the presence of the additive of this invention is so effective that the quantity of oxygen required to oxidize the carbon particles is considerably reduced hence having excess oxygen to oxidize the nitrogen components. Therefore, the air demand can be cut back to reduce $NO_x$ emissions yet retain the increased level of oxidizing carbon particles.

In the past, it has been observed that during typical coal-fired utility boiler practice, $NO_x$ emissions are directly proportional to the amount of excess air in the system. On the other hand, carbon and carbon particulates are inversely proportional to the amount of excess air [Sarofim, A. F. and Flagan, R. C. "$NO_x$ Control for Stationary Combustion Sources". *Prog. in Energy and Combustion Sci,* 2:1–25 (1976; Breen, B. P. and Sotter, J. G., "Reducing Inefficiency and Emission of Large Steam Generators in the United States", *Prog. in Energy and Combustion Sci,* 4:210–220 (1978)]. The predicted result therefore would be that as the excess air level is decreased, $NO_x$ emissions decrease and particulates containing carbon increases.

An operator of a coal-fired utility boiler would want to decrease excess air for two reasons: to comply with $NO_x$ pollution standards and ideally to improve overall plant efficiency without compromising combustion efficiency. As the operator decreases excess air for combustion, unfortunately a point is reached before the desired $NO_x$ emissions are achieved, where combustion efficiency begins to fall off resulting in high level of particulate carbon which is manifested as a black, smoky plume. Quite surprisingly, the use of the additive of this invention, during combustion of the pulverized coal, offers a means by which to maintain high levels of combustion efficiency at reduced levels of excess air.

To monitor the effect of the Carbonex ferrocene additive in coal, tests were conducted measuring a wide range of combustion performance characteristics in the presence and in the absence of Carbonex at two levels of excess air. The results of these tests are summarized below in Table 4 and graphically depicted in FIG. 5. The combustion performance characteristics in Table 4 had the following estimated standard deviations:

$O_2 \pm 2\%$;
$CO_2 \pm 2\%$;
$CO \pm 3\%$;
$NO_x \pm 2\%$;
Hydrocarbons $\pm 2\%$;
Particulate loading $\pm 5\%$;
Combustion efficiency $\pm 0.005\%$ Combustion efficiency is based on the extent to which elemental carbon in the fuel is oxidized to $CO_2$ upon combustion.

TABLE 4

RESULTS OF COMBUSTION TESTS ON PULVERIZED BITUMINOUS COAL FLAMES INJECTED WITH CARBONEX AT VARYING EXCESS AIR (10% to 26%)

| Combustion Performance Characteristic | Agent Injected Into Bituminous Coal Flame: Xylene (0 ppm iron) @ Excess Air 10% | Xylene 26% | Carbonex (5 ppm iron) @ Excess air 10% | Carbonex 26% |
|---|---|---|---|---|
| Furnace Gas Exit Temperature (F.) | 2230 | 2190 | 2340 | 2210 |
| $O_2$ (%, volume) | 2.1 | 5.2 | 2.1 | 5.2 |
| $CO_2$ (%, volume) | 16.6 | 14.7 | 16.8 | 14.8 |
| CO (ppm, volume) | 1000 | 50 | 40 | 40 |
| $NO_x$ (ppm, volume) | 200 | 450 | 450 | 730 |
| Carbon in Particulate Ash (%, weight) | 15.0 | 3.1 | 4.8 | 0.8 |
| Average Ash Particle Size (microns) | 20 | 18 | 13 | 20 |
| Fine Particulate Ash (% < 5 microns) | 8 | 8 | 8 | 6 |
| Particulate loading (pounds/million Btu) | 3.2 | 3.2 | 1.9 | 5.5 |
| Combustion Efficiency (%) | 98.35 | 99.62 | 99.30 | 99.88 |

As seen from the data presented in Table 4, the introduction of Carbonex as a fuel additive effected an increase in combustion efficiency at both levels of excess air; i.e., 98.35 to 99.30 and 99.62 to 99.88. The increase in combustion efficiency was paralleled by an increase in $NO_x$ production and a decrease in carbon in particulate ash. Unexpectedly, by reducing excess air from 26% to 10%, the increase in $NO_x$ emissions was reduced to levels comparable to the use of Xylene at 26% air without dropping combustion efficiency below the acceptable level of 99.00%. These findings suggest that at low levels of excess air Carbonex can be used as a coal combustion additive to maintain combustion efficiency without sacrificing environmental air quality in terms of $NO_x$ emissions.

The data presented in Table 4 suggests that the combination of Carbonex at 10% excess air results in a flame with similar characteristics to the control xylene flame at 26% air. These two flames show comparable $NO_x$ emissions, comparable emissions of products of incomplete combustion and comparable levels of combustion efficiency.

The unexpected finding is that at low levels of excess air, Carbonex can be used as a coal combustion additive to maintain combustion efficiency without sacrificing environmental air quality in terms of $NO_x$ emissions and permits the advantageous use of the physical characteristics of the flame and of the burner system.

The combustion of carbon in any burner system occurs under varying reaction conditions depending on where in the flame the carbon particles are located. The hottest part of the flame is the core which is fuel rich; i.e., excess air is low.

The temperature of the flame decreases along a gradient as one moves away from the hottest regions of the flame towards the edges of the flame. As one travels along this decreasing temperature gradient, the availability of air gradually increases.

Stages of combustion are therefore identifiable as ranging from:

(a) a fuel rich stage with high temperature and relatively low excess air - that is the reducing flame; to
(b) an air rich stage with lower temperatures and relatively high amounts of excess air - that is the oxidizing flame.

Recognition of these two stages of combustion provides an opportunity to construct in a known manner a staged combustion system that uses the temperature differentials and the excess air differentials at the various stages of combustion to suppress at least theoretically $NO_x$ emissions. However, in practice the use of staged combustion as a technique for reducing $NO_x$ emissions has not successfully decoupled the relationship between increases in particulates and other products of incomplete combustion and reduced $NO_x$ emissions.

Figure 6:
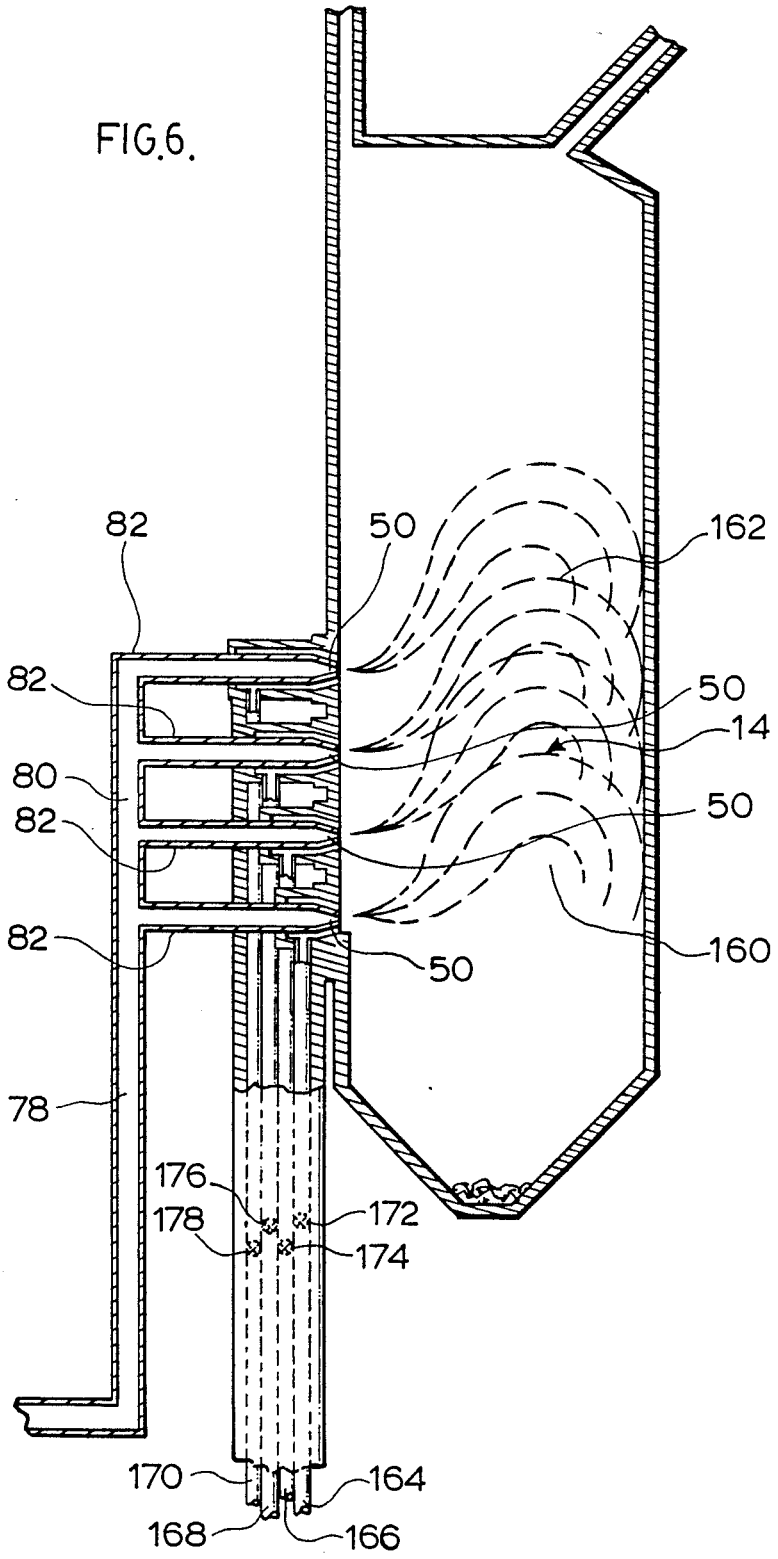
FIG. 6 is an enlarged schematic of the burner portion of the furnace of FIG. 1.

The use of the Carbonex additive in accordance with the invention provides the successful operation of staged combustion in an industrial scale coal fired furnace system. With reference to FIG. 6, an enlarged section of the burner portion of the furnace is provided. The pulverized coal is provided in main conduit 78 to the manifold 80. The plurality of coal injection conduits 82 deliver the coal to the injection nozzles 50 to supply the fireball in the manner discussed with respect to FIG. 1.

Air is supplied around each nozzle 50 to support combustion of the injected coal to maintain the fireball 14. The details of the air supply are discussed in more detail with respect to FIG. 2. To accomplished stage combustion, the amount of excess air supplied along the height of the fireball 14 is controlled. Less excess air is provided at the lower region 160 of the fireball to establish the reducing flame region. Greater amounts of excess air are introduced at the upper region 162 to establish the oxidizing flame region. The amount of excess air introduced from the lower region 160 to the upper region 162 is increased sequentially to provide in the fireball 14 a transition from the reducing flame to the oxidizing flame.

To accomplish this sequentially increased amount of excess air at each injection nozzle 50, it is necessary to modify the air supply system. The compressed combustion air from compressor 74 is now supplied to four independent ducts 164, 166, 168 and 170. Proportional air flow control valves 172, 174, 176 and 178 are provided respectively in ducts 164, 166, 168 and 170. The air control valves are preferably electronically operated to control the volume of air supplied at the respective nozzle injection site. The electronic control may be provided by the controller 134. The control program for the controller is adapted to provide, based on other inputs, the necessary volumes of excess air at each injection site 50 to establish the staged combustion from the reducing flame region to the oxidizing flame region. The controller then sets for the detected conditions of coal delivery, the valves 172, 174, 176 and 178 at the correct proportional opening to deliver the necessary amount of excess air for each stage in the combustion process. For purposes of demonstration it is appreciated the proportional valves may be set to deliver excess air levels beginning at 10%. excess air at the lowest stage at 13%, excess air at the first intermediate stage, at 17% excess air at the second intermediate stage and at 20% excess air at the highest stage.

The Carbonex additive has made staged combustion a feasible and workable combustion methodology. At low levels of excess air, combustion efficiency is increased in the presence of the Carbonex additive while maintaining acceptable levels of $NO_x$ emissions. The increase in combustion efficiency in the reducing flame is made possible by the presence of the Carbonex additive, improves total combustion at this stage resulting in fewer byproducts of incomplete combustion escaping as soot, smoke and other pollutants. At the same time, the use of oxygen starvation at this stage inhibits the formation of $NO_x$.

When the remaining carbon particulates move into the oxidizing region of the flame, excess air can be increased to assist in oxidizing the remaining carbon particulates. The excess air introduced at this later stage does not pose a risk with respect to $NO_x$ emissions because of the lower temperatures in this area of the flame. Therefore through the use of the Carbonex additive, staged combustion systems can be established having beneficial advantages of increased combustion efficiency and decreased products of incomplete combustion without effecting an increase in $NO_x$ formation.

Support for the use of Carbonex in staged combustion systems is found in Table 5 below. The data presented in Table 5 was generated in a detuned burner system. As is understood a detuned burner system approximates reaction conditions similar to those in staged combustion discussed above.

Reducing excess air from 20% to 10% in low-swirl or coarse-sized coal flames injected with 5 ppm Carbonex iron resulted in a net reduction in $NO_x$ of about 25% while maintaining combustion efficiency at the 98%+ level.

In summary, these tests confirm that the additive is a viable coal additive. It can be seen that the additive functions to catalyze combustion under reducing conditions. Therefore, the additive can be used to improve combustion efficiency in staged or detuned combustors. The advantage of this technology is that you can achieve reduced $NO_x$ emissions and maintain acceptable combustion efficiencies.

The Carbonex additive now allows one to use the principle of stages of combustion in the form of a staged combustion system or a detuned combustion system. Without the Carbonex additive attempts to control $NO_x$ have resulted in higher particulate emissions, such as soot and smoke. For this reason, such combustion systems have not been attractive alternatives. However, with the addition of Carbonex to the pulverized coal fuel, the efficiency of such combustion is enhanced. By resolving the problem of particulate emissions while maintaining acceptable levels of $NO_x$ emissions, many environmental benefits as well as economic benefits are achieved. This is an unexpected result, since all previous work indicated that it was a basic law of combustion that the products of incomplete combustion would increase as $NO_x$ emissions were reduced. Having discovered the surprising result that combustion efficiency and pollutant emissions can be controlled through modulation of oxygen availability and the Carbonex additive, it is recognized that various specific embodiments can be devised to commercially implement and apply this technological innovation. Such approaches would include, whole flame burner systems, staged combustion and detuned combustion. Other embodiments of the burner systems, in which the invention may be employed, would be appreciated by those skilled in the art.

TABLE 5

RESULTS OF COMBUSTION TESTS ON PULVERIZED BITUMINOUS COAL FLAMES INJECTED WITH CARBONEX AS A FUNCTION OF SWIRL AND PARTICLE SIZE

| Agent Injected | Carbonex Iron (ppm, wt) | Burner Swirl | Coal Grind (%-200 mesh) | Mass-Mean Coal Size (microns) | Excess Combustion Air (%) | $NO_x$ Emmisisons (ppm, 0% $O_2$Dry)[1] | Mass-Mean Particulate Size (microns)[2] | Particulate loading (lb/$10^6$ Btu) | Combustion Efficiency (%) |
|---|---|---|---|---|---|---|---|---|---|
| Xylene | 0 | Detuned | 80 | 22 | 10 | 400 | 14 | 5.4 | 95.0 |
| Xylene | 0 | Tuned | 60 | 50 | 10 | 500 | 15 | 7.8 | 95.5 |
| Carbonex | 5 | Detuned | 80 | 22 | 10 | 570 | 10 | 4.2 | 98.8 |
| Carbonex | 5 | Tuned | 60 | 50 | 10 | 550 | 13 | 5.4 | 98.2 |
| Xylene | 0 | Detuned | 80 | 22 | 26 | 600 | 13 | 3.8 | 96.5 |
| Xylene | 0 | Tuned | 60 | 50 | 26 | 680 | 14 | 4.4 | 97.0 |
| Carbonex | 5 | Detuned | 80 | 22 | 26 | 800 | 11 | 2.8 | 99.0 |
| Carbonex | 5 | Tuned | 60 | 50 | 26 | 720 | 13 | 3.4 | 98.7 |

[1]data corrected to 0% excess oxygen to allow direct comparison
[2]found in combustion products As shown in the data of Table 5, reducing secondary combustion air swirl and increasing average coal particle size for xylene carrier-injected coal flames decreases $NO_x$ emissions, increases mass-mean particulate size, increases particulate loading and decreases combustion efficiency. These changes appear to be more or less a function of excess air.

Injecting 5 ppm Carbonex iron into the detuned or coarser-sized high-volatile bituminous coal flames increased $NO_x$ emissions has decreased mass-mean particulate size, decreased particulate loading and increased combustion efficiency, with the incremental changes offsetting those caused by detuning the burner or coarser grinding the coal.

Although preferred embodiments of the invention have been described herein in detail, it will be understood by those skilled in the art that variations may be made thereto without departing from the spirit of the invention or the scope of the appended claims.

I claim:

1. A process for improving combustion efficiency in a coal-fired furnace while maintaining acceptable levels of $NO_x$ emissions from such combustion, the coal-fired furnace having at least one site for introducing a pulverized coal into said furnace to develop and maintain a fireball in said furnace and at least one site for introducing air to support burning of said pulverized coal in said fireball, said process comprising introducing at at least one site a useful amount of an additive composition for measurably improving combustion efficiency while maintaining acceptable levels of $NO_x$ emissions by controlling excess air requirements to support said burning of said pulverized coal;

said composition comprising:

(1) a dicyclopentadienyl iron compound selected from the group consisting of ferrocene and its derivatives represented by the formula:

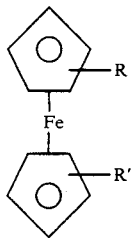

wherein each of R and R', independent of the other, is hydrogen, alkyl, cycloalkyl, aryl or heterocyclic, and (2) an organic carrier liquid in which said dicyclopentadienyl iron compound is soluble, controlling excess air supplied to said furnace to support burning of said pulverized coal at a level which emits acceptable concentration of particulates containing carbon at a desired combustion efficiency where use of said additive permits;

1. reducing excess air supplied to said furnace compared to a normal excess air requirement for combustion in the absence of said additive, to achieve in the presence of said additive said desired combustion efficiency and said acceptable concentration of particles of carbon at said reduced supply of air; and 2. simultaneously maintaining a level of $NO_x$ emissions which is below normal levels of $NO_x$ emissions in the absence of said additive for combustion of said coal at a level which achieves said desired combustion efficiency and said acceptable concentration of particles of carbon.

2. A process of claim 1 wherein stages of combustion are developed in said fireball by controlling introduction of excess air to said fireball, said fireball having reducing flame regions and oxidizing flame regions, introducing said additive to a reducing flame region of said fireball to enhance combustion of said particles of carbon.

3. A process of claim 1 wherein approximately 1 ppm up to 100 ppm of iron in said composition based on the amount of coal being delivered to said furnace is injected into said furnace fireball.

4. A process of claim 3, wherein approximately 0.1 to 5 ppm of iron in said composition is injected into said fireball.

5. A process of claim 4 wherein said dicyclopentadienyl iron compound is selected from the group consisting of dicyclopentadienyl iron, di(methylcyclopentadienyl-)iron, di(ethylcyclopentadienyl)iron, methylferrocene, ethylferrocene, n-butylferrocene, dihexylferrocene, phenylferrocene, m-tolyferrocene, didecylferrocene, dicyclohexylferrocene and dicyclopentylferrocene.

6. A process of claim 5, wherein said carrier is selected from the group consisting of high flash point aromatic solvents, hydrocarbon solvents, and petroleum based solvents.

7. A process of claim 6, wherein said solvents are selected from the group consisting of xylene, toluene, hexanol, octanol, kerosene, fuel oil, petroleum spirits and Solvesol 100 TM.

8. A process of claim 6, wherein said solvents have a viscosity in the range of 50 centipoises or less at 20° C.

9. A process of claim 8, wherein said viscosity is in the range of 0.3 to 3 centipoises at 20° C.

* * * * *